US010553228B2

(12) United States Patent
Purnhagen et al.

(10) Patent No.: US 10,553,228 B2
(45) Date of Patent: Feb. 4, 2020

(54) AUDIO CODING WITH RANGE EXTENSION

(71) Applicant: Dolby International AB, Amsterdam Zuidoost (NL)

(72) Inventors: Heiko Purnhagen, Stockholm (SE); Per Ekstrand, Stockholm (SE); Harald Mundt, Nuremberg (DE); Klaus Peichl, Nuremberg (DE)

(73) Assignee: Dolby International AB, Amsterdam Zuidoost (NL)

( * ) Notice: Subject to any disclaimer, the term of this patent is extended or adjusted under 35 U.S.C. 154(b) by 44 days.

(21) Appl. No.: 15/563,936

(22) PCT Filed: Apr. 1, 2016

(86) PCT No.: PCT/EP2016/057232

§ 371 (c)(1),
(2) Date: Oct. 2, 2017

(87) PCT Pub. No.: WO2016/162283

PCT Pub. Date: Oct. 13, 2016

(65) Prior Publication Data

US 2018/0130480 A1 May 10, 2018

Related U.S. Application Data

(60) Provisional application No. 62/144,163, filed on Apr. 7, 2015, provisional application No. 62/260,845, filed on Nov. 30, 2015.

(51) Int. Cl.

| | |
|---|---|
| ***G10L 19/035*** | (2013.01) |
| ***G10L 19/02*** | (2013.01) |
| ***G10L 19/00*** | (2013.01) |

(52) U.S. Cl.

CPC ..... *G10L 19/035* (2013.01); *G10L 19/0204* (2013.01); *G10L 2019/0002* (2013.01); *G10L 2019/0004* (2013.01)

(58) Field of Classification Search

CPC ..... G10L 19/005; G10L 19/028; G10L 19/03; G10L 19/032; G10L 19/0204; G10L 19/035; G10L 2019/0002

(Continued)

(56) References Cited

U.S. PATENT DOCUMENTS 7,269,552 B1 * 9/2007 Prange ..... G10L 19/04 704/219
8,077,769 B2 * 12/2011 Krishnan ..... H04N 19/176 375/240

(Continued)

FOREIGN PATENT DOCUMENTS

WO 2011/124473 10/2011

OTHER PUBLICATIONS

Digital Audio Compression (AC-4) Standard, Part 1: Channel Based coding; Draft ETSI TS 103 190-1 ETSI Draft, European Telecommunications Standards Institute (ETSI), 650, vol. Broadcast No. V1.2.1, pp. 1-302, Feb. 23, 2015.

*Primary Examiner* — James S Wozniak

(57) ABSTRACT

Disclosed are some examples of systems, apparatus, methods and computer program products implementing techniques for extending the range of a set of decoded parameter values for a sequence of frequency bands in an identifiable time frame of an audio signal. In some implementations, the parameter values vary in relation to a sequence of time frames of the audio signal and in relation to a sequence of frequency bands in each time frame. In some implementations, it is determined that a decoded value corresponds to a minimum of a first range of values of a first coding protocol of a set of coding protocols. The determined value is modified to be below the minimum of the first range of values to produce an extended value. A modified set of decoded values including one or more extended values can thus be provided.

17 Claims, 14 Drawing Sheets

(58) Field of Classification Search
USPC ..... 704/230, 500–501
See application file for complete search history.

(56) References Cited

U.S. PATENT DOCUMENTS

2003/0115041 A1* 6/2003 Chen ..... G10L 19/02 704/200.1
2003/0176934 A1* 9/2003 Gopalan ..... G11B 20/00891 700/94
2003/0233234 A1* 12/2003 Truman ..... G10L 19/035 704/203
2004/0181406 A1* 9/2004 Garrett ..... H03M 13/2957 704/242
2004/0260545 A1 12/2004 Gao
2005/0015249 A1 1/2005 Mehrotra
2005/0226426 A1* 10/2005 Oomen ..... G10L 19/008 381/23
2008/0091440 A1* 4/2008 Oshikiri ..... G10L 19/02 704/501
2009/0030676 A1* 1/2009 Xu ..... G10L 15/02 704/203
2010/0169081 A1* 7/2010 Yamanashi ..... G10L 19/0204 704/203
2010/0286990 A1* 11/2010 Biswas ..... G10L 19/035 704/500
2010/0324708 A1* 12/2010 Ojanpera ..... G10L 19/008 700/94
2011/0170711 A1* 7/2011 Rettelbach ..... G10L 19/02 381/98
2011/0208528 A1* 8/2011 Schildbach ..... G10L 19/008 704/500
2012/0263312 A1* 10/2012 Takada ..... G10L 19/0204 381/73.1
2013/0110506 A1* 5/2013 Norvell ..... G10L 19/038 704/205
2013/0110522 A1* 5/2013 Choo ..... G10L 21/00 704/500
2013/0114733 A1* 5/2013 Fukui ..... H03M 7/3082 375/240.22
2013/0339036 A1* 12/2013 Baeckstroem ..... G10L 19/012 704/500
2014/0114651 A1* 4/2014 Liu ..... G10L 19/0017 704/203
2014/0156284 A1* 6/2014 Porov ..... G10L 19/0017 704/500
2015/0319438 A1* 11/2015 Shima ..... H04N 19/176 375/240.03
2016/0042744 A1* 2/2016 Klejsa ..... G10L 19/035 704/230
2016/0140974 A1* 5/2016 Valero ..... G10L 19/028 381/22
2016/0210977 A1* 7/2016 Ghido ..... G10L 19/038
2016/0232903 A1* 8/2016 Choo ..... G10L 19/0017
2017/0092282 A1* 3/2017 Choo ..... G10L 19/18

* cited by examiner

AUDIO CODING WITH RANGE EXTENSION

TECHNICAL FIELD

This disclosure relates to audio signal coding. In particular, this disclosure relates to range extension techniques for decoding digital audio signals.

BACKGROUND

The development of digital encoding and decoding for digital audio signals continues to have a significant effect on the delivery and enjoyment of entertainment content. Perceptual audio coding systems, which enable conveying encoded audio signals at low bitrates while maintaining perceptual quality of the signal when decoded, can employ techniques to characterize certain properties of the audio signal. Parameters can be used to characterize such properties. These parameters can, for example, indicate an energy or level of the signal as a function of time and of frequency. For this purpose, often a time/frequency grid is used. The grid includes a set of time segments, also referred to as time frames, and a set of frequency bands represented in each time frame. For each point in the grid, a respective parameter describes a signal property for the corresponding frequency band and time frame. The points in the grid are sometimes referred to as time/frequency tiles. With most audio signals, the parameters often vary slowly across time and frequency. Thus, time-differential or frequency-differential coding can be performed on the parameter to convey it efficiently, for instance, at a sufficiently low bitrate in a bitstream.

SUMMARY

Disclosed are some examples of systems, apparatus, methods and computer program products implementing techniques for audio coding with range extension.

In some examples, a set of encoded values for a sequence of frequency bands in an identifiable time frame of an audio signal is processed. The encoded values vary in relation to a sequence of time frames of the audio signal and in relation to the sequence of frequency bands. The set of encoded values is decoded to produce decoded values. The decoding uses at least a first coding protocol of a set of coding protocols, where the first coding protocol is associated with direct coding of the audio signal. For at least one frequency band of the sequence of frequency bands in the identifiable time frame, such as a lowest frequency band, it is determined that a decoded value corresponds to a minimum of a first range of values of the first coding protocol. The determined value is modified to be below the minimum to produce an extended value. In some implementations, a second decoded value associated with a second frequency band of the sequence is identified as being below the minimum of the first range of values, and the second value is provided as the extended value. The decoded values including the extended value can be provided for further processing.

In some examples, a set of decoded values for a sequence of frequency bands in an identifiable time frame is received. The decoded values vary in relation to the sequence of time frames of the audio signal and in relation to the sequence of frequency bands. For at least one frequency band of the sequence of frequency bands in the identifiable time frame, it is determined that a decoded value corresponds to a minimum of a first range of values of the first coding protocol. The determined value is modified to be below the minimum to produce an extended value. In some implementations, decoded values associated with an upper range of frequency bands of the sequence of frequency bands are identified. The extended value is determined as an extrapolation of the identified decoded values.

In some examples, an audio coding system includes an encoder and a decoder. The encoder is operable to obtain parameters characterizing at least one property of an audio signal. The parameters vary in relation to a sequence of time frames of the audio signal and in relation to a sequence of frequency bands in each time frame. For each time frame, the encoder is further operable to encode a set of the parameters for the sequence of frequency bands in the time frame to produce a set of encoded values. The encoding uses at least a first coding protocol of a set of coding protocols. The encoder is further operable to store the set of encoded values on a storage medium, and/or provide the set of encoded values on a communications medium. The decoder is operable, for each time frame, to retrieve the set of encoded values from the storage medium, and/or receive the set of encoded values on the communications medium. The decoder is further operable to decode the set of encoded values to produce a set of decoded values. The decoder is further operable to identify any decoded values as corresponding to a minimum of a first range of values of the first coding protocol, and modify any identified values to be below the minimum as explained above.

Some examples of the disclosed systems, apparatus, methods and computer program products may be implemented via hardware, firmware, software stored in one or more non-transitory data storage media, and/or combinations thereof. For example, at least some aspects of this disclosure may be implemented in apparatus that includes an interface system and a control system. The interface system may include a user interface and/or a network interface. In some implementations, the apparatus may include a memory system. The interface system may include at least one interface between the control system and the memory system. The control system may include at least one processor, such as a general purpose single- or multi-chip processor, a digital signal processor (DSP), an application specific integrated circuit (ASIC), a field programmable gate array (FPGA) or other programmable logic device, discrete gate or transistor logic, discrete hardware components, and/or combinations thereof. In some non-limiting examples, the control system may be capable of performing part or all of a range extension process, as disclosed herein.

Details of some implementations of the subject matter described in this disclosure are set forth in the accompanying drawings and the description below. Other features, aspects, and advantages will become apparent from the description, the drawings and the claims. Note that the relative dimensions of the following figures may not be drawn to scale.

BRIEF DESCRIPTION OF THE FIGURES

Like reference numbers and designations in the various Figures indicate like elements.

DETAILED DESCRIPTION

Figure 1:
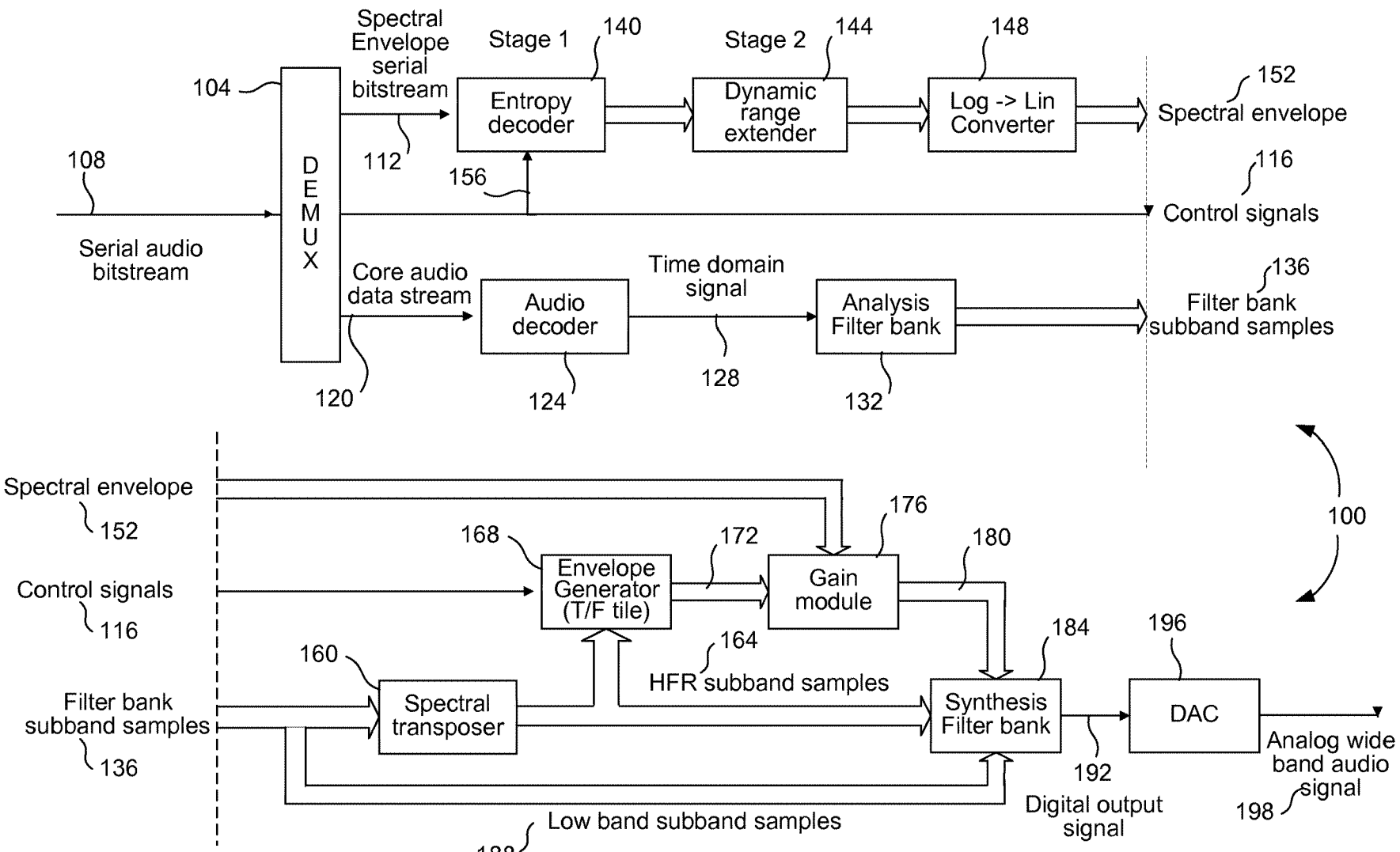
FIG. 1 is a block diagram showing an example of an audio decoding system 100.

Disclosed are some examples of systems, apparatus, methods and computer program products implementing techniques for extending the range of decoded parameter values of a digital audio signal. By way of illustration, a decoding system can receive from an encoding system a set of encoded parameter values characterizing a sequence of frequency bands in a given time frame of the digital audio signal. A first stage of the decoding system is configured to decode the set of encoded values using one or more codebooks to produce a set of decoded values. A second stage of the decoding system is configured to perform range extension on the set of decoded values by identifying one or more of the decoded values as being equal to a minimum of a first range of values available by one of the codebooks. The second stage of the decoding system can extend any identified value(s) to be below the minimum to produce a modified set of decoded values for further processing. In some implementations, the first stage of the decoding system can perform time- and/or frequency-differential decoding using three codebooks explained in further detail below, while the second stage can perform a decoded parameter value modification not affecting the processing of the first stage.

The teachings disclosed herein can be applied in various different ways. In some implementations, examples of the disclosed techniques can be applied to extend the dynamic range of parameters in a high frequency reconstruction (HFR) system in a backwards compatible manner. As an example, a decoder implementing some of the disclosed techniques can also decode legacy bitstreams, generally referring to bitstreams without extended ranges. This is made possible since the disclosed examples of range extension techniques do not call for changes to the underlying bitstream syntax, nor changes to associated codebooks. Some examples provided in this disclosure can be implemented in the context of the Dolby AC-4 audio format of the Dolby Audio™ family, the Dolby AC-3 audio codec (also known as "Dolby Digital"), or the Enhanced AC-3 audio codec (also known as E-AC-3 or "Dolby Digital Plus"), although the disclosed teachings are not limited to such Dolby Audio™ contexts. Some examples of the concepts disclosed herein can be implemented in the context of other audio codecs, including but not limited to MPEG-2 AAC and MPEG-4 AAC. Some of the disclosed examples may be implemented in various audio encoders and/or decoders provided by various manufacturers, and may be included in mobile telephones, smartphones, desktop computers, handheld or portable computers, netbooks, notebooks, smartbooks, tablets, stereo systems, portable listening devices, televisions, DVD players, digital recording devices and a variety of other devices and systems. Accordingly, the teachings of this disclosure are not intended to be limited to the implementations shown in the figures and/or described herein, but instead have wide applicability.

In the case of frequency-differential coding, the value of a parameter for the first, often the lowest, frequency band of a sequence of frequency bands in a given time frame is generally coded absolutely rather than differentially. Absolute coding is also referred to herein as direct coding. Absolute or direct coding is generally used on the first frequency band because there usually is no previous frequency band relative to which the lowest frequency band could be differentially coded. Thus, different codebooks can be used, depending on the mode of coding (time- or frequency-differential coding) to be performed and depending on the particular frequency band to be coded for a given time frame.

In some implementations, a parameter is coded using three different codebooks: F0, DF, and DT. For a time frame using frequency-differential coding, the value for the first frequency band in the sequence of bands is conveyed directly using codebook F0, and each subsequent frequency band is coded relative to the previous band in the same frame using codebook DF. For a frame using time-differential coding, the value of the parameter in each frequency band is coded relative to the same band in the previous frame using codebook DT. To minimize error propagation in a decoder in case of transmission errors and to enable fast tune-in when starting to decode the bitstream of an ongoing broadcast, by way of example, frequency-differential coding can be used by an encoder in regular time intervals, for instance, once or twice per second. For other frames, the encoder can be configured to select the coding mode that is most efficient, for instance, that uses the smallest number of bits.

Generally, the range of values a parameter can have immediately after being decoded is determined by the range of values covered by the codebook used. In particular, for the coding mode of frequency-differential coding, the range of parameter values for the first band is determined by the range covered by the F0 codebook. The range of parameter values possible for the remaining bands, or for all of the bands in the case of time-differential coding, is often larger. By way of illustration, in a non-limiting example, the three codebooks cover integer values of parameters in the following ranges:

F0: 0 to 35

DF: −35 to 35

DT: −35 to 35

In this example, for a frame using frequency-differential coding, and for the first band, only parameter values in the range of 0 to 35 can be represented, while for the second band, values as low as −35 or as high as 70 can be represented, assuming that the first band had the lowest or highest possible values, respectively.

In a legacy implementation, however, an encoder can be configured to truncate negative values to 0 in a quantization step. Similarly, if the decoder finds values below 0, for instance, after delta decoding, the frame can be deemed erroneous. The highest value (35 in this example) could represent the power obtained in a time/frequency tile when encoding a full scale sinusoid centered in the corresponding frequency band. In the present example, since values are forced into the range of 0 to 35, the range of the F0 codebook, the largest positive step possible from one value to the next (when delta coding in time or frequency) is from 0 to 35 (+35), which is the positive limit for the DF and DT codebooks, and the largest negative step possible is from 35 to 0 (−35), which signifies the negative limit of the DF and DT codebooks.

In some implementations, different techniques are disclosed to extend and facilitate extending the range of values a decoded parameter can have. Some techniques are provided in the context of frequency-differential coding, while at least one technique is applicable in the context of time-differential coding. In some examples, techniques are applied to extend decoded parameter values beyond the range of values of the F0 codebook. Such techniques can be beneficial in some implementations where the F0 codebook has been set and cannot easily be altered to extend the codebook's range.

Below are some non-limiting examples of different range extension techniques to illustrate some of the disclosed implementations. In the numerical examples, the same three codebooks—F0, DF and DT—having the same numerical ranges as the example above are used. Using implementations of some disclosed techniques, even lower values than '0' can be achieved for the first frequency band, where '0' is the lowest possible value if no range extension techniques are used. In some examples below, values in the range from −12 to 35 for the first band can be represented.

In some but not all examples, lower parameter values representing soft sounds correspond to low energy levels in a time/frequency tile, and relatively higher parameter values representing loud sounds correspond to high energy levels. In the following examples, the value 0 corresponds to a very soft but still audible sound level, while the value −12 corresponds to a sound level that is below the threshold of perception and, hence, characterizes complete silence. Those skilled in the art should appreciate that the claims are not limited to the disclosed numerical ranges of these examples, and low parameter values and high parameter values can represent other signal properties than soft and loud sounds.

FIG. 1 is a block diagram showing an example of an audio decoding system 100. In FIG. 1, decoding system 100 includes a number of components described below. One component is a demultiplexer 104 connected as part of an audio coding signal chain to receive an encoded audio signal in the form of a serial audio bitstream 108. Demultiplexer 104 is configured to demultiplex serial audio bitstream 108 into at least 3 separate signals or streams, as shown in FIG. 1. In particular, demultiplexer 104 is adapted to demultiplex serial audio bitstream 108 into a spectral envelope serial bitstream 112, one or more control signals 116 and a core audio data stream 120, as shown in FIG. 1. Core audio data stream 120 is received and processed by audio decoder 124 to convert core audio data stream 120 to a time domain signal 128. An analysis filter bank 132 is coupled to receive and process time domain signal 128 to produce filter bank subband samples 136.

In FIG. 1, a first stage of decoding is performed by entropy decoder 140, which is coupled to receive and decode spectral envelope serial bitstream 112 from demultiplexer 104. Control signals 116 are provided at control input 156 of entropy decoder 140 to control the first stage of decoding of spectral envelope serial bitstream 112. Decoded values produced by entropy decoder 140 from spectral envelope serial bitstream 112 are provided to a second stage of decoding in the form of a dynamic range extender 144, which is adapted to perform any of the implementations of range extension techniques as disclosed herein, for example, as described below with reference to FIG. 5, 6 or 7. Any decoded values can be modified, as further explained below, by dynamic range extender 144 to produce extended values as part of a modified set of decoded values using some of the implementations disclosed herein. Modified or unmodified sets of decoded values are output from dynamic range extender 144 to a converter 148, which is configured to produce a reference spectral envelope 152 characterizing the decoded values output from dynamic range extender 144.

In FIG. 1, a spectral transposer 160 is coupled to receive and transpose filter bank subband samples 136 to produce HFR subband samples 164. An envelope generator 168 is coupled to receive control signals 116 and HFR subband samples 164 and process both signals 116 and samples 164 to produce a spectral envelope 172 for time/frequency tiles given by control signal 116. A gain module 176 is coupled to receive reference spectral envelope 152 and spectral envelope 172 computed by envelope generator 168 and calculate gain values 180 for the time/frequency tiles. An envelope adjuster 182 receives HFR subband samples 164 and gain values 180 and applies gains to the time/frequency tiles of the subband samples. A synthesis filter bank 184 is coupled to receive inputs in the form of low band subband samples 188 derived from filter bank subband samples 136 and gain adjusted HFR subband samples 166 to produce a digital time-domain output signal 192. A digital-to-analog converter (DAC) 196 is coupled to receive digital output signal 192 and convert signal 192 to an analog wide band audio signal 198. Analog audio signal 198 can be provided to various other additional components, processing units, amplifiers, etc. for further processing.

Figure 2:
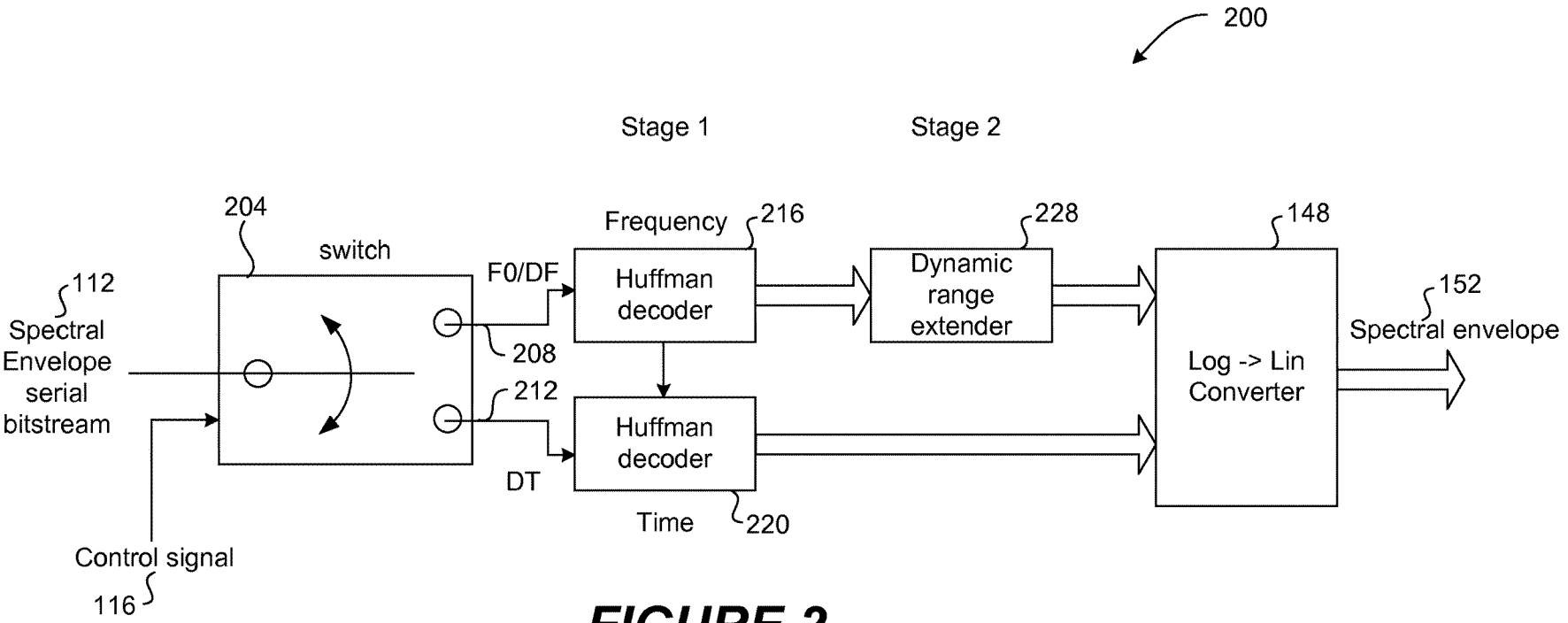
FIG. 2 is a block diagram showing an example of components 200 for processing a spectral envelope serial bitstream of audio decoding system 100.

FIG. 2 is a block diagram showing one example of components 200 for processing a spectral envelope serial bitstream of audio decoding system 100. In FIG. 2, the entropy decoder 140 (stage one) and dynamic range extender 144 (stage two) components of FIG. 1 are implemented in the form of components 204, 216, 220 and 228. In the example of FIG. 2, spectral envelope serial bitstream 112 and a control signal 116 are provided as inputs to a switch 204, which is adapted to output frequency-differential coded frames 208 and time-differential coded frames 212 at separate outputs. In this example, two separate Huffman decoders 216 and 220 provide the first stage of decoding, where decoder 216 is in a frequency-differential coded path to decode frames 208, while decoder 220 is in a time-differential coded path to decode frames 212 and produce respective outputs. In this example, techniques for performing range extension on frequency-differential coded signals are implemented by dynamic range extender 228, which is coupled to receive sets of decoded values from decoder 216. In this example, dynamic range extender 228 is a second stage of decoding coupled in the frequency-differential coded path to modify decoded values produced by decoder 216.

Figure 3:
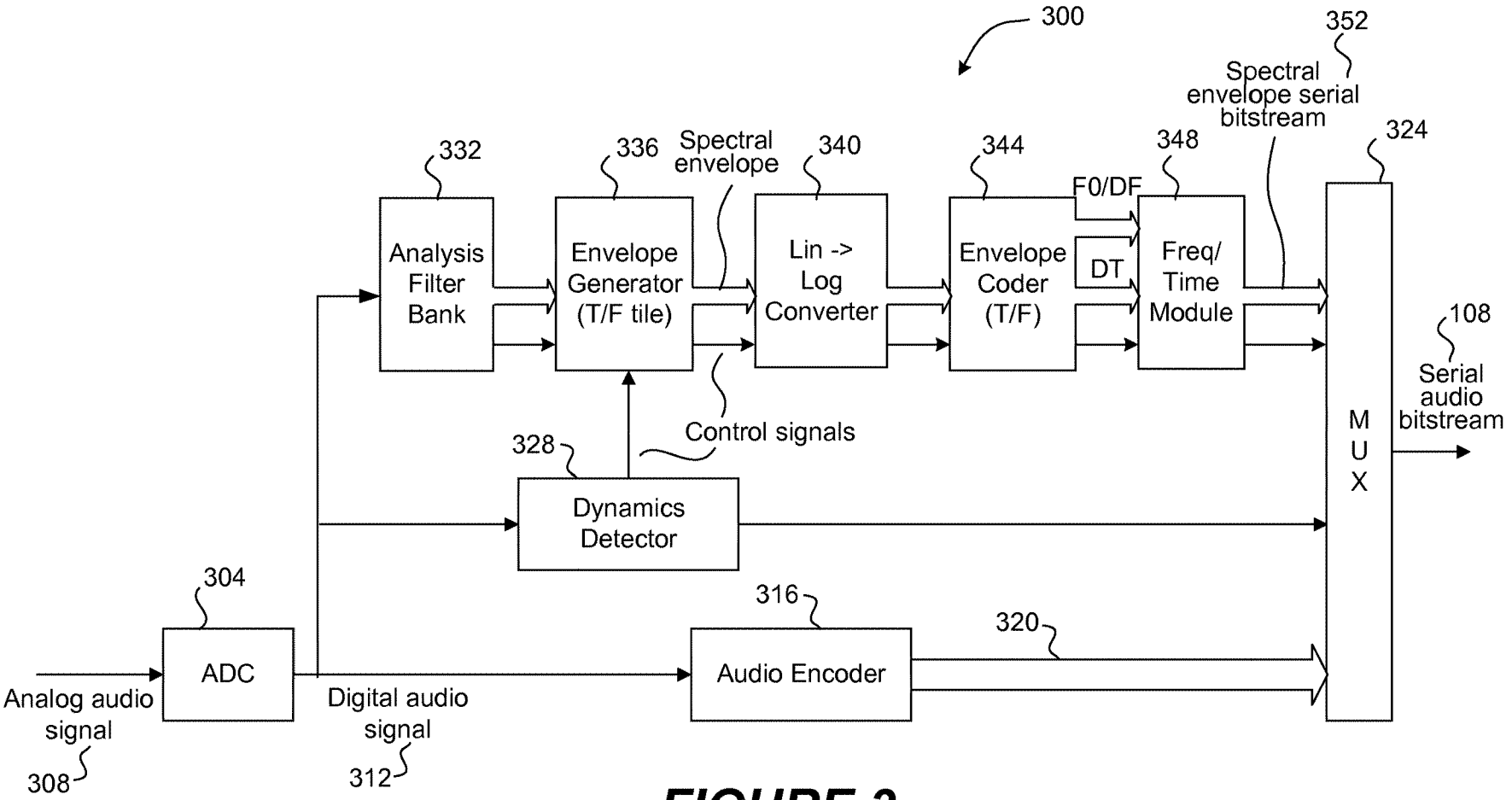
FIG. 3 is a block diagram showing an example of an audio encoding system 300.

FIG. 3 is a block diagram showing an example of an audio encoding system 300. In FIG. 3, an analog-to-digital converter (ADC) 304 receives an input analog audio signal 308. A digital audio signal 312 produced by ADC 304 is provided along at least three signal paths, as shown in FIG. 3. In a first signal path, an audio encoder 316 is configured to encode sets of parameter values for time frames of digital audio signal 312 to produce sets of encoded values 320 and provide encoded values 320 to a multiplexer 324, as shown in FIG. 3. In FIG. 3, digital audio signal 312 is provided along a second signal path to dynamics detector 328, which is configured to detect dynamics of signal 312 and provide a control signal to an envelope generator 336.

In FIG. 3, digital audio signal 312 is also provided along a third signal path to several additional components. In particular, an analysis filter bank 332 produces subband samples from digital audio signal 312 and provides such samples to an envelope generator 336. Envelope generator 336 also has a control input coupled to receive control signals from dynamics detector 328 and use the control signals to generate time/frequency tiles, which are conveyed in the form of a spectral envelope to converter 340. Control signals provided from envelope generator 336 to converter 340 govern the conversion of the spectral envelope to a converted envelope, which is provided to envelope coder 344 along with control signals by converter 340.

In the example of FIG. 3, envelope coder 344 is configured to apply frequency-differential coding using the F0 and DF codebooks to produce a frequency-differential coded signal. Envelope coder 344 is also configured to perform time-differential coding using the DT codebook to produce a time-differential coded signal. A frequency/time module 348 receives the frequency-differential and time-differential coded signals along with one or more control signals from envelope coder 344 and processes the received signals to provide a spectral envelope serial bitstream 352 to multiplexer 324. Typically, frequency/time module 348 selects either the frequency-differential or the time-differential coded signal as an output in the form of spectral envelope serial bitstream 352 depending on the coding error or the bit consumption for the two alternatives. Multiplexer 324 is configured to generate a serial audio bitstream 108 from the various signals delivered to multiplexer 324, as described above. Serial audio bitstream can be provided to various processing stages including any of the examples of decoding systems or apparatus disclosed herein.

Figure 4:
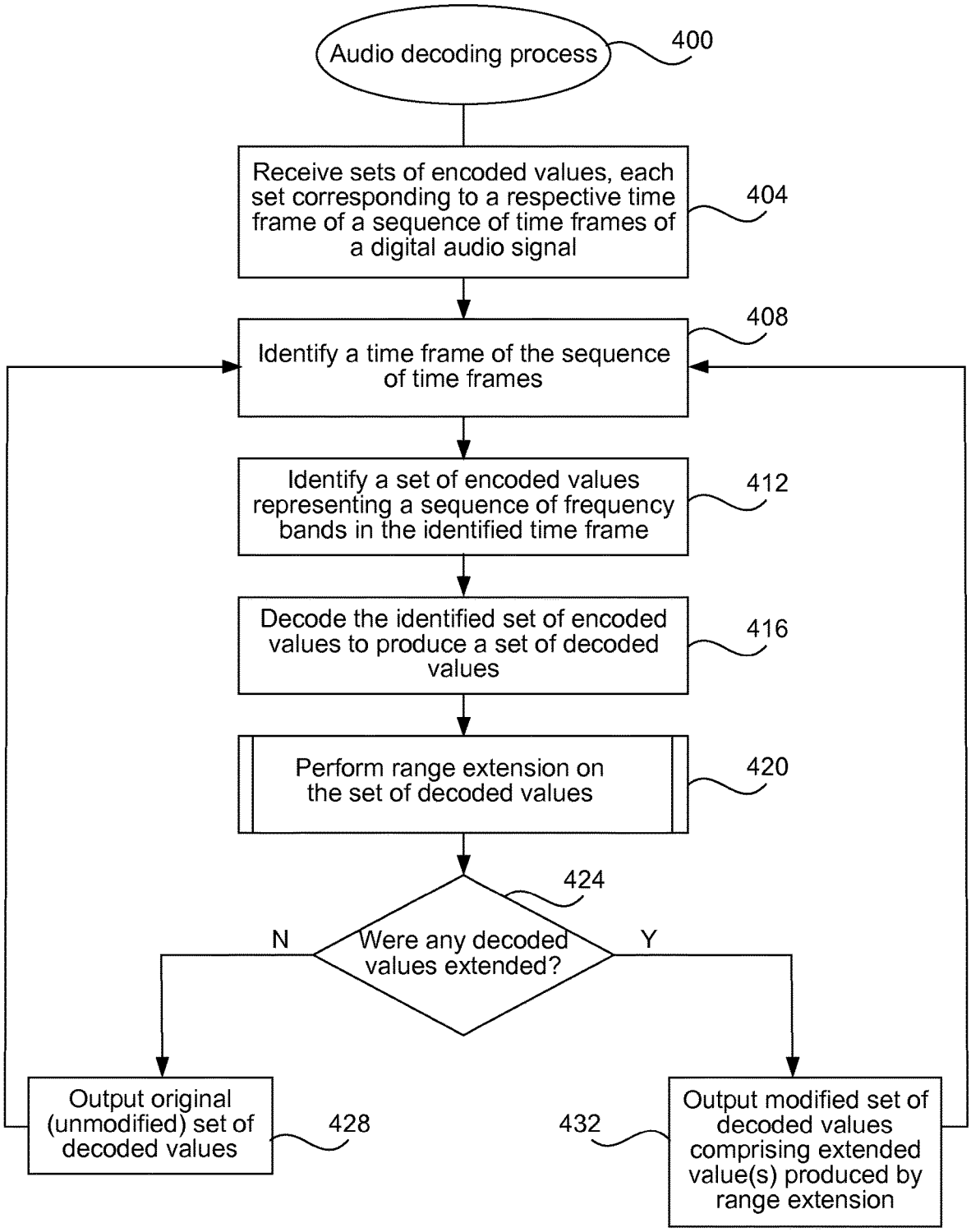
FIG. 4 is a flow diagram showing an example of an audio decoding process 400.

FIG. 4 is a flow diagram showing an example of an audio decoding process 400. The process of FIG. 4 is described with reference to the examples of FIGS. 1 and 2, although those skilled in the art should appreciate that the operations of FIG. 4 are applicable to various other implementations of decoders and decoding systems. At 404 of FIG. 4, a decoder such as entropy decoder 140 of FIG. 1 receives sets of encoded values, where each set corresponds to a respective time frame of a sequence of time frames of a digital audio signal. For example, spectral envelope serial bitstream 112 of FIG. 1 can provide a sequence of sets of encoded values corresponding to a sequence of time frames of an encoded audio signal provided as serial bitstream 108 to demultiplexer 104. Serial bitstream 108 of FIG. 1 can be received on any suitable communications medium, such as any wired or wireless transmission channel, an Ethernet cable, a data bus, etc. In some other implementations, sets of encoded values can be retrieved from a suitable data storage medium such as RAM, a hard drive, a USB drive, or other non-transitory data storage medium.

At 408 of FIG. 4, a time frame of the sequence of time frames of an encoded audio signal can be identified, e.g., selected for processing. Those skilled in the art should appreciate that the identification of a time frame at 408 can occur naturally as a result of processing a sequence of sets of encoded values in a serial bitstream. For a given time frame in a sequence of time frames, at 412, a set of encoded values representing a sequence of frequency bands in the given time frame is identified or selected. Again, the particular set of encoded values identified or selected at 412 can occur naturally by processing data in order as it is received in a serial bitstream or retrieved from a data storage medium.

At 416 of FIG. 4, a set of encoded values identified or selected at 412 is decoded, for example, by entropy decoder 140 of FIG. 1 or Huffman decoders 216 and 220 of FIG. 2, to produce a set of decoded values. In the examples of FIGS. 1 and 2, the codebooks F0, DF and DT define respective coding protocols. That is, a first coding protocol of the set is based on the F0 codebook, while second and third coding protocols are based on the DF and DT codebooks, respectively. In the example of FIG. 1, entropy decoder 140 decodes a set of encoded values using the F0, DF and DT codebooks, while in FIG. 2, Huffman decoder 216 uses the F0 and DF codebooks for decoding in the frequency domain, and Huffman decoder 220 uses the DT codebook for decoding in the time domain.

At 420 of FIG. 4, any of the disclosed examples of range extension techniques are performed on a set of decoded values. For example, in FIG. 1, dynamic range extender 144 is provided to perform range extension on a set of decoded values output from entropy decoder 140, while in FIG. 2, dynamic range extender 228 is provided to perform range extension for frequency-differential coded signals on a set of decoded values output by Huffman decoder 216.

At 424 of FIG. 4, it is determined whether any decoded values were extended at 420. When no decoded values in a set were extended, process 400 proceeds to 428, at which a reference spectral envelope 152 of FIG. 1 or 2 is generated based on the unmodified set of decoded values. Returning to 424, when one or more decoded values were extended at 420, at 432, a modified set of decoded values having one or more extended values produced by range extension is provided to define spectral envelope 152. Such a spectral envelope can be provided for further processing as part of or following a signal path of a decoding system, as described above with reference to FIGS. 1 and 2. Following 428 or 432, process 400 returns to 408, at which another, often subsequent, time frame in a sequence of timeframes is identified for processing a corresponding set of encoded values representing frequency bands in an identified time frame.

Figure 5:
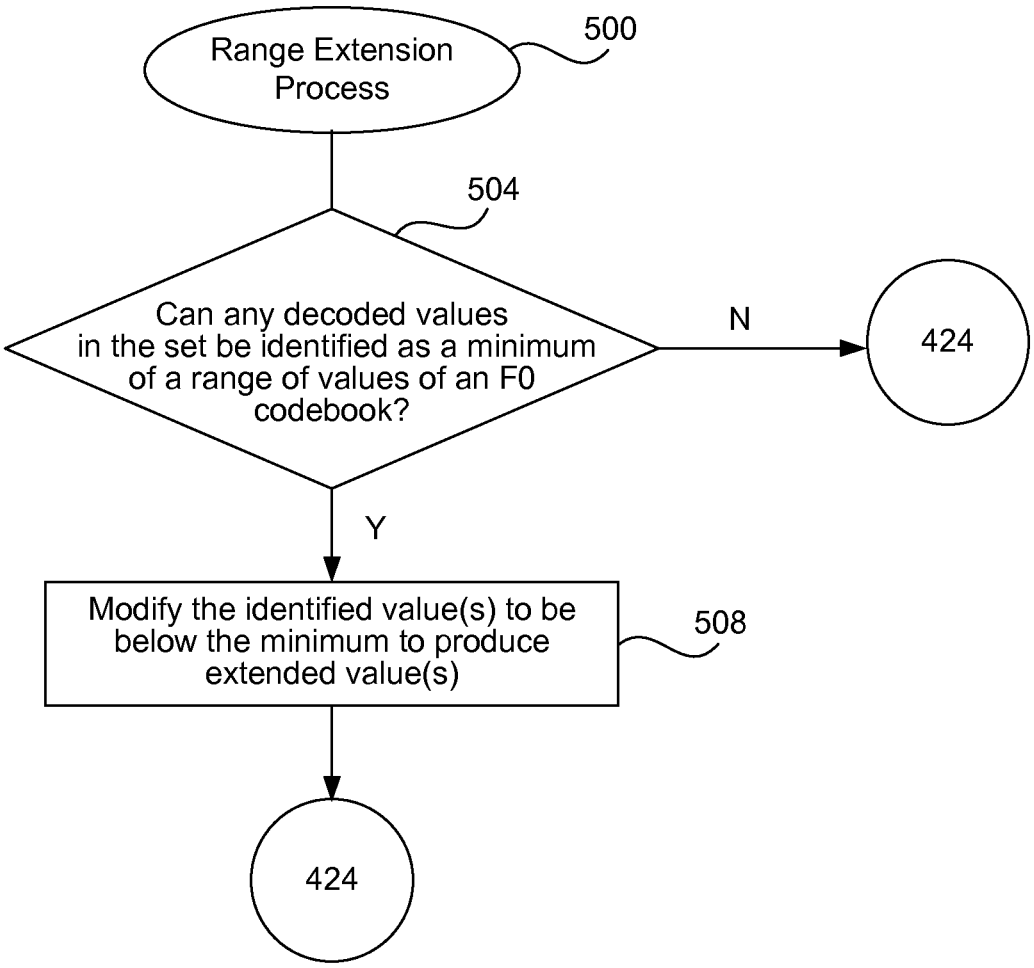
FIG. 5 is a flow diagram showing an example of a range extension process 500 capable of being performed as part of audio decoding process 400.

FIG. 5 is a flow diagram showing an example of a range extension process 500 capable of being performed at 420 of FIG. 4. In FIG. 5, at 504, a second stage of a decoding system such as dynamic range extender 144 of FIG. 1 is configured to determine whether any decoded values in a set correspond to a minimum of a range of values of a codebook, as explained above. For example, at 504, any decoded values having a value of 0 when an F0 codebook having a range from 0 to 35 can be identified. When any such values are identified at 504, process 500 proceeds to 508, at which any identified value(s) can be modified to be below the minimum to produce extended values before processing returns to 424 of FIG. 4. Returning to 504, in this example, if no decoded values in a set have a value of 0, that is, when the F0 codebook having a range of 0 to 35 is used, processing returns to 424 of FIG. 4. This range extension technique of FIG. 5 makes it possible to represent complete silence in any time/frequency tile, since range extension process 500 is applicable to both time-differential and frequency-differential coding.

Figure 6:
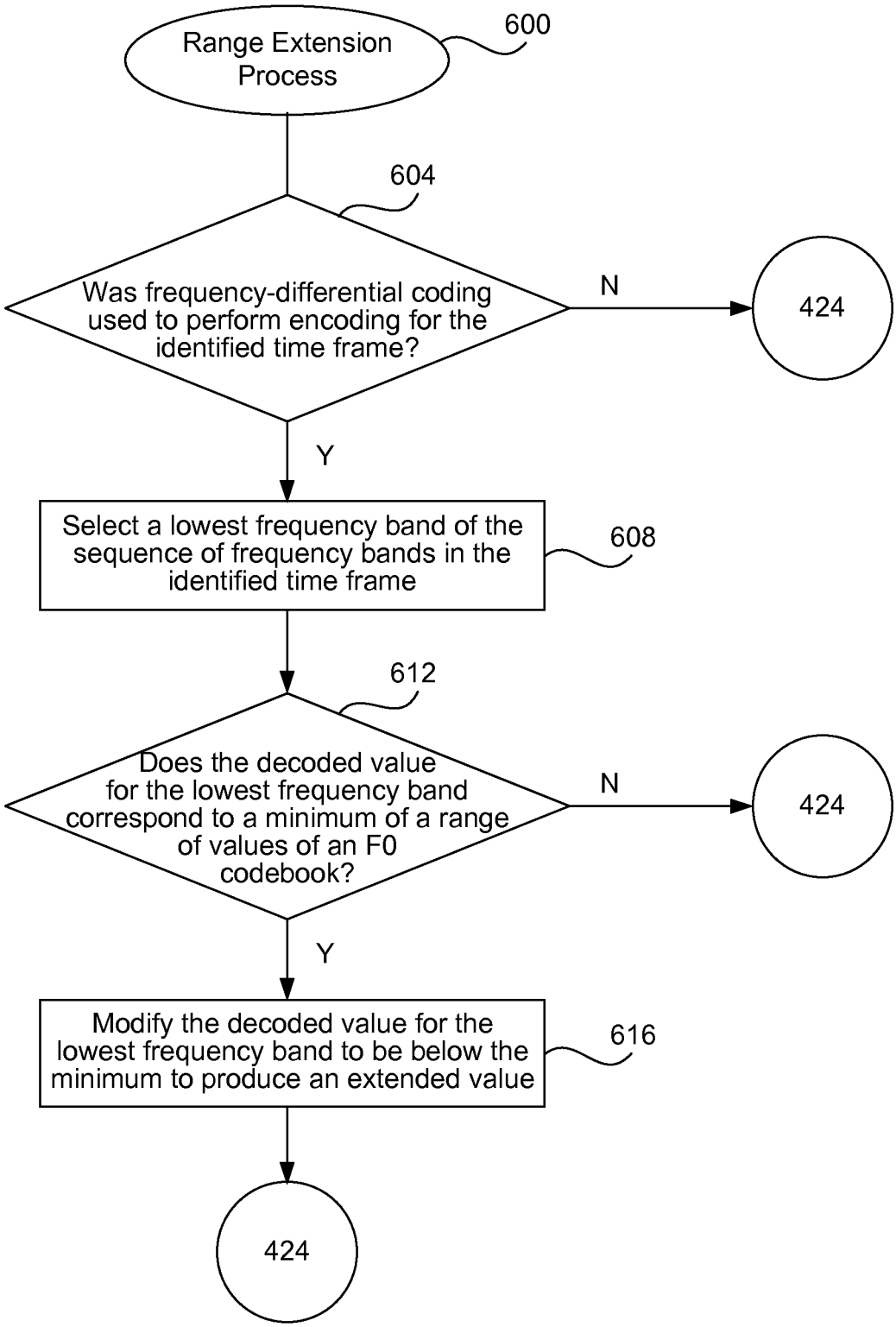
FIG. 6 is a flow diagram showing another example of a range extension process 600 capable of being performed as part of audio decoding process 400.

FIG. 6 is a flow diagram showing another example of a range extension process 600 capable of being performed at 420 of FIG. 4. In FIG. 6, at 604, it is determined whether frequency-differential coding was used to encode a given time frame. That is, process 600 is only applicable to time frames for which frequency-differential coding was performed. In situations where frequency-differential coding was not performed, processing returns to 424 of FIG. 4, as described above. At 604, when a given time frame was encoded using frequency-differential coding, at 608, the first, often lowest, frequency band of the sequence of frequency bands in the given time frame is selected or identified, for instance, by dynamic range extender 144 of FIG. 1. At 612, following 608, it is determined whether the decoded value for the first frequency band corresponds to a minimum of a range of values of the F0 codebook, in the example above. That is, in the example where the F0 codebook has a range of 0 to 35, when a decoded value for the first frequency band is 0, at 612, the process proceeds to 616 as explained below. At 612, if the decoded value for the first frequency band does not correspond to a minimum of the range of values defined by the F0 codebook, in this example, the decoded value is not modified, and processing returns to 424 of FIG. 4.

In FIG. 6, at 616, any decoded value identified at 612 as corresponding to a minimum of the F0 range of values is modified to be below the minimum and thus produce an extended value. For example, if the unmodified value is 0, the value can be altered to be −12. Following 616, processing returns to 424 of FIG. 4 as described above. In the process of FIG. 6, those skilled in the art should appreciate that the values of all other bands than the first frequency band in the sequence of bands for a given time frame, and all of the values for a time frame coded using time-differential coding, are left unchanged.

Figure 7:
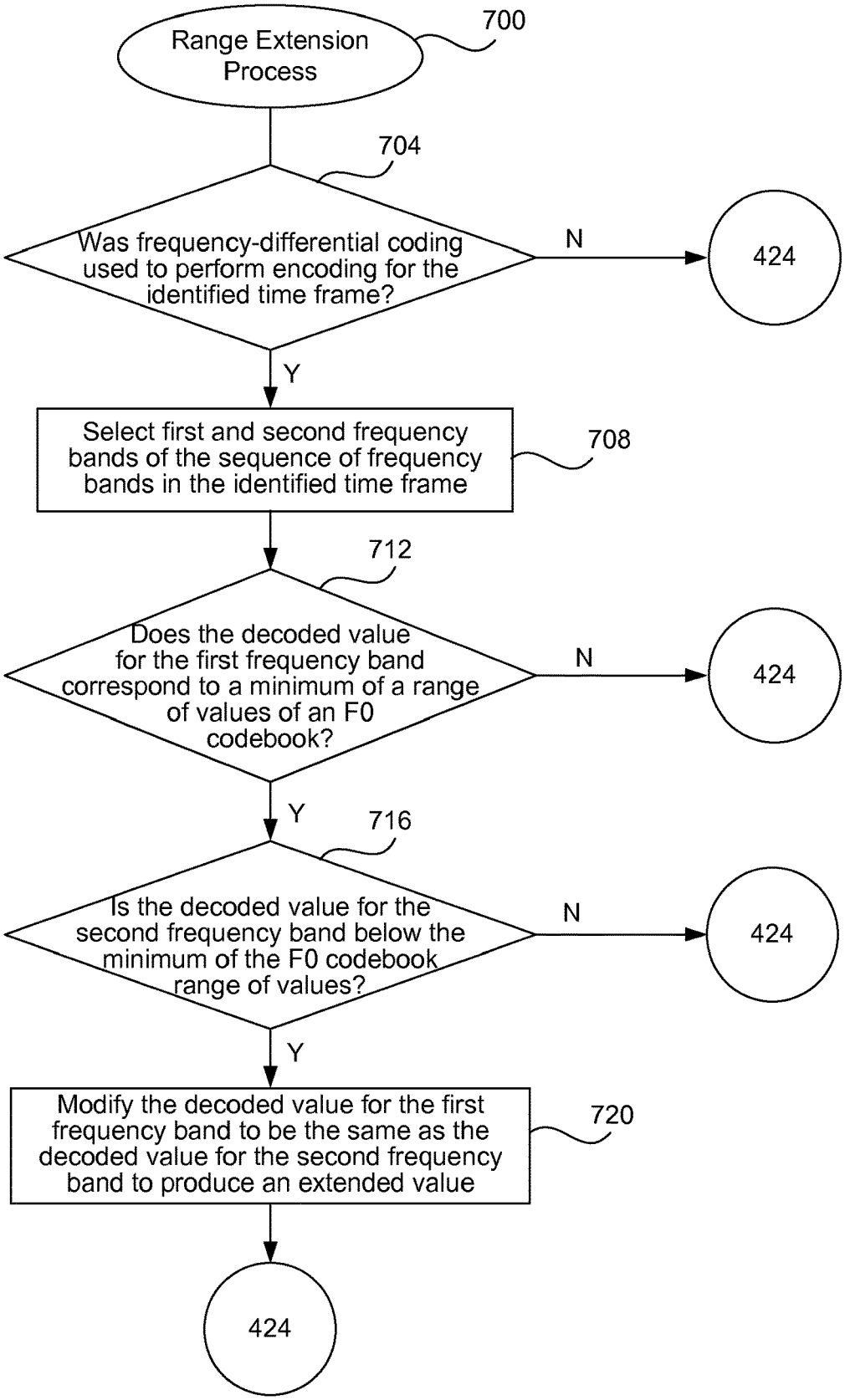
FIG. 7 is a flow diagram showing another example of a range extension process 700 capable of being performed as part of audio decoding process 400.

FIG. 7 is a flow diagram showing another example of a range extension process 700 capable of being performed at 420 of FIG. 4. Process 700 of FIG. 7 is similar to process 600 of FIG. 6 in that range extension is only performed when frequency-differential coding was used to encode parameter values for an identified time frame, as shown at 704. When frequency-differential coding was not used, at 704, processing returns to 424 of FIG. 4. At 704 of FIG. 7, when frequency-differential coding was used, at 708, the first and second frequency bands of a sequence of frequency bands in the identified time frame are selected at 708. For example, the lowest frequency band and next-to-lowest band can be selected at 708 by dynamic range extender 144 of FIG. 1.

At 712 of FIG. 7, it is determined whether the decoded value for the first frequency band corresponds to a minimum of a range of values of the F0 codebook, in this example. For instance, at 712, when the decoded value for the first frequency band is 0 and the F0 codebook has a range of values of 0 to 35, processing proceeds to 716, as described below. At 712, when the decoded value for the first frequency band does not align with the minimum, e.g., 0 in the example above, processing proceeds to 424 of FIG. 4.

At 716 of FIG. 7, it is determined whether the decoded value for the second frequency band of the sequence of frequency bands in the given time frame being processed is below the minimum of the F0 range of values, e.g., less than 0 when the F0 codebook has a range of 0 to 35. At 716, when the decoded value for the second frequency band is greater than or equal to the minimum, processing returns to 424 of FIG. 4, as described above. At 716 of FIG. 7, when the decoded value for the second frequency band is below the minimum, e.g., below 0 when the F0 codebook has a range of 0 to 35, processing proceeds to 720 at which the decoded value for the first frequency band is modified to be the same as the decoded value for the second frequency band. In other words, at 720, an extended value is produced by modifying the first frequency band value to be the second frequency band value. In the example above, in which the F0 codebook has a range of 0 to 35, at 720, if the unmodified value of the first band is 0 and the unmodified value of the second band is less than 0, the value of the first band is changed to take on the unmodified value of the second band. Otherwise, the value of the first band is left unchanged. Those skilled in the art should appreciate that process 700 of FIG. 7 leaves the values of all other bands than the first frequency band and values of all bands and frames using time-differential coding unchanged. Following 720, processing returns to 424 of FIG. 4, as described above.

As an alternative to the processing of FIG. 7, the decoded value representing the first frequency band of the sequence of frequency bands in a given time frame can be identified and compared with the minimum of the range of values of the F0 codebook. When the decoded value for the first frequency band is equal to the minimum, decoded values associated with an upper range of the sequence of frequency bands in the time frame can be identified, and an extended value for the first frequency band can be generated as an extrapolation of the decoded values for the upper range. As an example, the first frequency band may be determined as a value linearly extrapolated from the four parameter values closest above.

In some alternative implementations, the last (e.g., highest) frequency band of a sequence of frequency bands in a given time frame can be assigned the value of the next-to-last band when delta decoding. Delta coded values would start beginning from the F0 band when the decoded value for the first frequency band is equal to the minimum of the F0 codebook; i.e., the first DF value would indicate the delta offset for the first band, that is the same band also coded using the F0 codebook. Similarly, in the above case, an extra DF value could also be signaled when F0 equals 0, representing the missing delta value for the last band.

Figure 8:
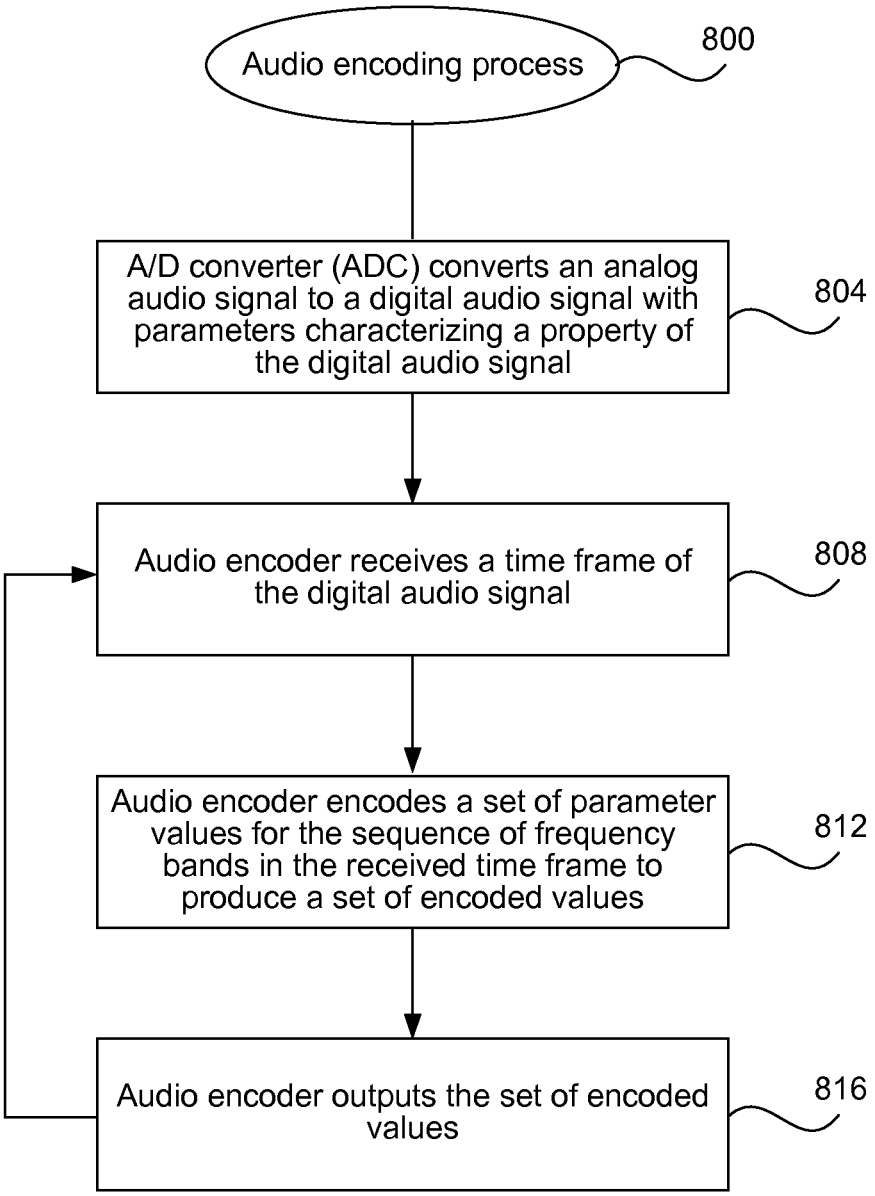
FIG. 8 is a flow diagram showing an example of an audio encoding process 800.

FIG. 8 is a flow diagram showing an example of an audio encoding process 800. In FIG. 8, at 804, ADC 304 of FIG. 3 converts analog audio signal 308 to digital audio signal 312 with parameters characterizing a property such as an energy level of digital audio signal 312. As mentioned above, digital audio signal 312 is generally structured with a sequence of time frames and a sequence of frequency bands in each time frame, for example, using analysis filter bank 332 in FIG. 3. The parameters vary in relation to the sequence of time frames and in relation to the sequence of frequency bands in each time frame, as explained above. At 808 of FIG. 8, envelope generator 336 of FIG. 3 receives a time frame of digital audio signal 312. Time frames of digital audio signal 312 can be provided in sequence to envelope generator 336 so successive time frames of the sequence can be identified and processed by envelope generator 336. At 812 of FIG. 8, envelope coder 344 of FIG. 3 encodes a set of the parameter values for the sequence of frequency bands in the time frame received at 808 to produce a set of encoded values. In some implementations in which the parameters of a digital audio signal characterize an energy level, each encoded value in the set produced at 812 represents an energy level of a respective frequency band of the sequence of frequency bands in the time frame being processed.

In some implementations, when envelope coder 344 encodes digital audio signal 312 using the F0, DF and DT codebooks, for the first frequency band of a sequence of frequency bands in a time frame, often the encoded values for the first frequency band in the sequence is limited to a range of values representable by the F0 codebook, for instance, the range of 0 to 35 in the example above. Also, in some implementations, when the range extension techniques of FIGS. 6 and 7 are to be performed by a decoding system, envelope coder 344 of FIG. 3 can be configured to quantize all parameter values lower than −12 to −12, rather than 0, to increase the representable range. Thus, in such implementations, a decoding system is desirably configured to permit values as low as −12 after delta coding. In a legacy system, i.e., a system without any of the range extension capabilities disclosed herein, all parameter values, for all frequency bands, would generally be limited by the encoder to the values representable by the F0 codebook, e.g., 0 to 35. When extending the range to −12 to 35, in this example, values below 0 can be encoded using the DF and DT codebooks except for the first frequency band in the case of coding in the frequency direction where the F0 codebook is used. For the first frequency band in this case, values below 0 are encoded as 0. Hence, the subsequent delta coding in the frequency or time direction uses 0 as a reference when encoding relative to the F0 value.

At 816 of FIG. 8, frequency/time module 348 of FIG. 3 outputs a set of encoded values, conveyed as spectral envelope serial bitstream 352. In the example of FIG. 3, sets of encoded values output from frequency/time module 348 are provided to multiplexer 324. In this and other examples, such encoded values can be communicated over any suitable communications medium to other processing modules and/or can be stored on a suitable data storage medium. Returning to FIG. 8, following 816, process 800 returns to 808 for processing the next time frame of a sequence of time frames of digital audio signal 312.

Figure 9:
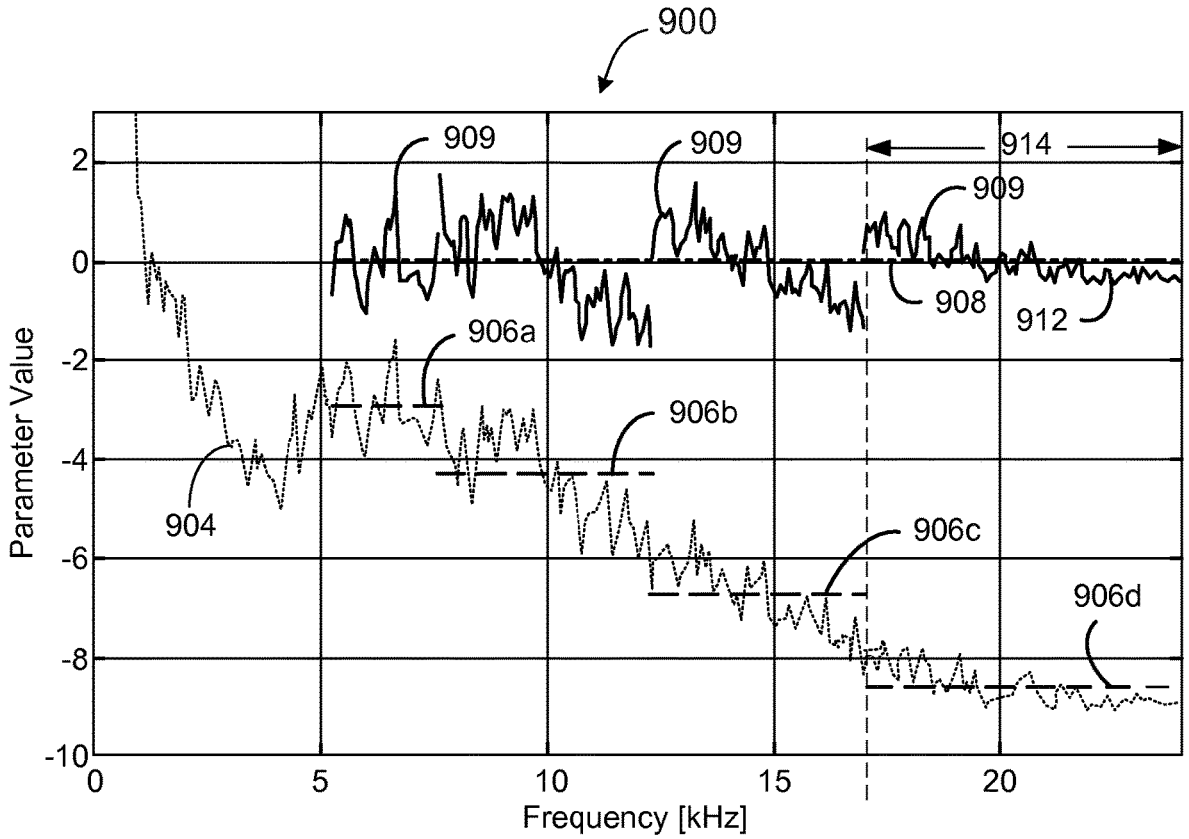
FIG. 9 is a graph 900 showing parameter coding of a legacy system not implementing any of the range extension techniques disclosed herein.

FIG. 9 is a graph 900 showing parameter coding of a legacy system not implementing any of the range extension techniques disclosed herein. In FIG. 9, a frequency spectrum 904 of an input digital audio signal is shown with parameter values 906*a*, 906*b*, 906*c* and 906*d* before quantization. In this example, all unquantized parameter values 906*a*-906*d* are below 0, as shown in FIG. 9, and hence quantized to decoded parameter values of 0, as shown by trace 908, resulting in a decoder output spectrum 909 as shown in FIG. 9. In a decoding system, a portion 912 of decoder output spectrum 909 in a high-frequency band 914 of a sequence of frequency bands for a time frame is reconstructed with an average level of 0. A signal reconstructed with an average level of 0 may correspond to a signal with a level above the threshold of hearing, for example, a signal with a level corresponding to the noise floor of a 14 bit pulse code modulation (PCM) quantizer, thus resulting in audible high frequency noise at the output of the decoder. Such noise is undesirable if the original signal at the encoder input did not have any audible content in high-frequency bands.

Figure 10:
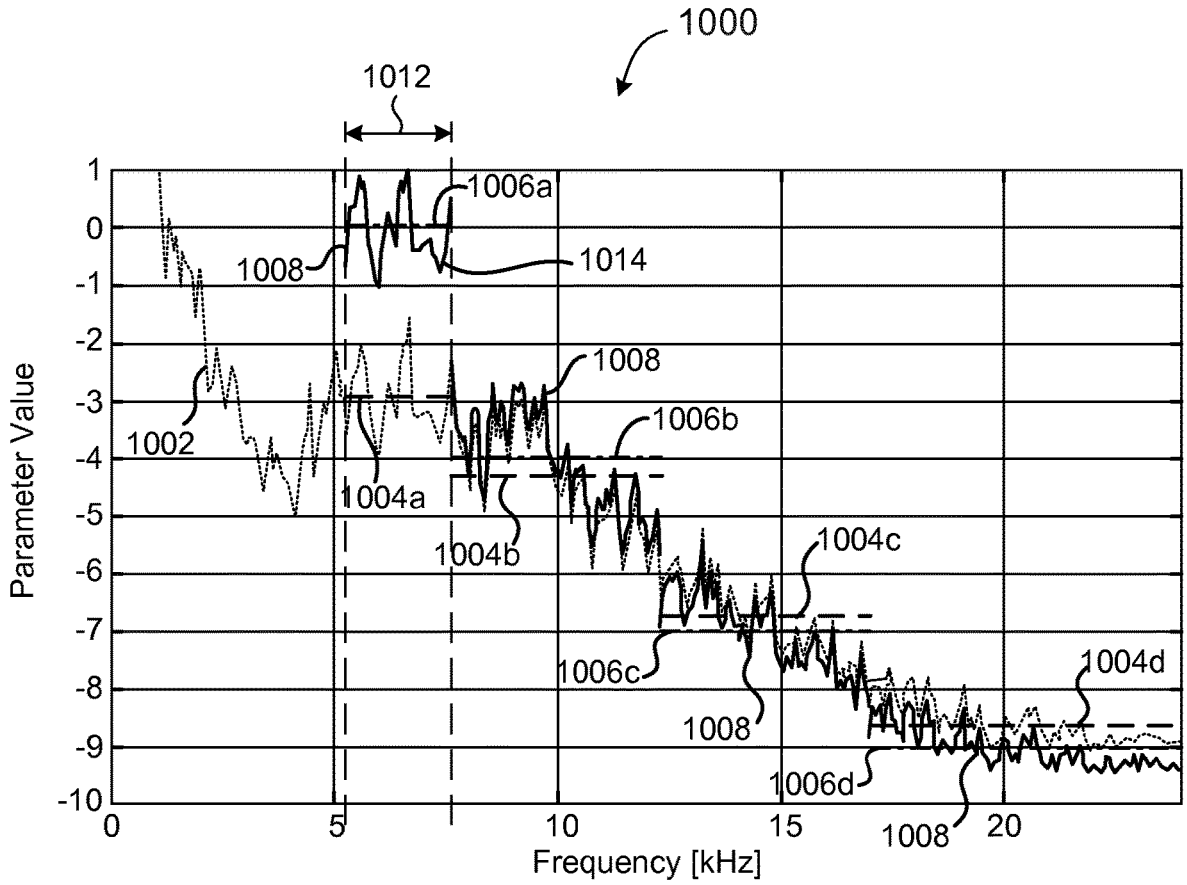
FIG. 10 is a graph 1000 showing an example of an extended parameter range by allowing negative parameter values.

FIG. 10 is a graph 1000 showing an example of an extended parameter range by allowing negative parameter values. In this example, negative parameter values in an encoding system and a decoding system are enabled by delta coding in combination with relaxed parameter range limits. An input signal spectrum 1002 is shown with unquantized parameter values 1004*a*, 1004*b*, 1004*c* and 1004*d*. Decoded parameter values are shown by traces 1006*a*, 1006*b*, 1006*c* and 1006*d*. Energy levels of a decoder output spectrum 1008 for frequencies other than a lowest frequency band 1012 are close to unquantized parameter values 1004*b*-1004*d*. However, the energies of portion 1014 of decoder output spectrum 1008 for lowest frequency band 1012 are closer to 0 rather than being close to unquantized parameter value 1004*a* since the F0 codebook is restricted to values between 0 and 35 in this example.

Figure 11:
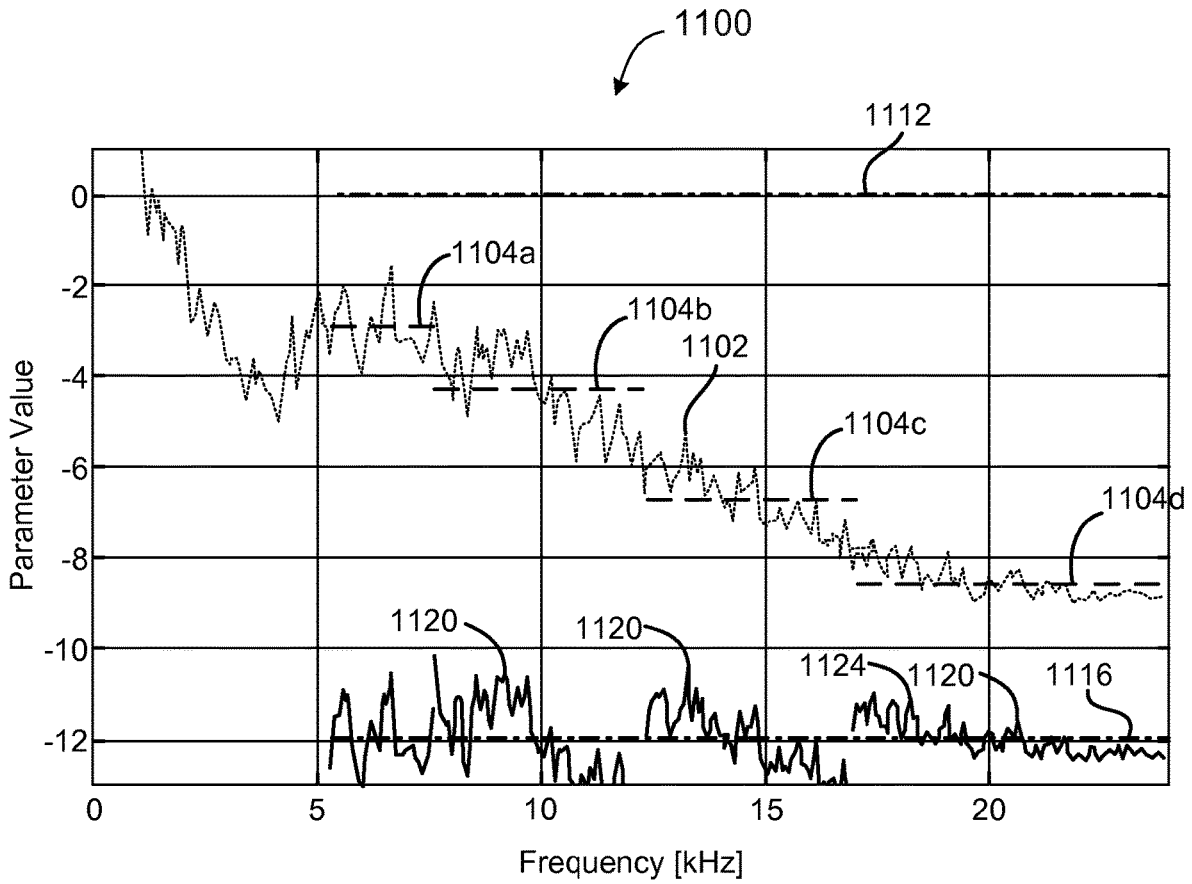
FIG. 11 is a graph 1100 showing an example of a first range extension technique.

FIG. 11 is a graph 1100 showing an example of a first range extension technique, where parameter values in a given time frame are identified and compared with the minimum of the range of values of the F0 codebook. When the parameter values are equal to the minimum, in this case 0, the values are replaced with a smaller value. In FIG. 11, an input signal spectrum 1102 is shown with unquantized parameter values 1104*a*, 1104*b*, 1104*c* and 1104*d*. In this example, all decoded parameter values having a value of 0, illustrated by trace 1112, are transformed to a value of −12, illustrated by trace 1116. In FIG. 11, a decoder output spectrum 1120 includes a reconstructed high band portion 1124 having an energy level well below the energy level of input signal spectrum 1102.

Figure 12:
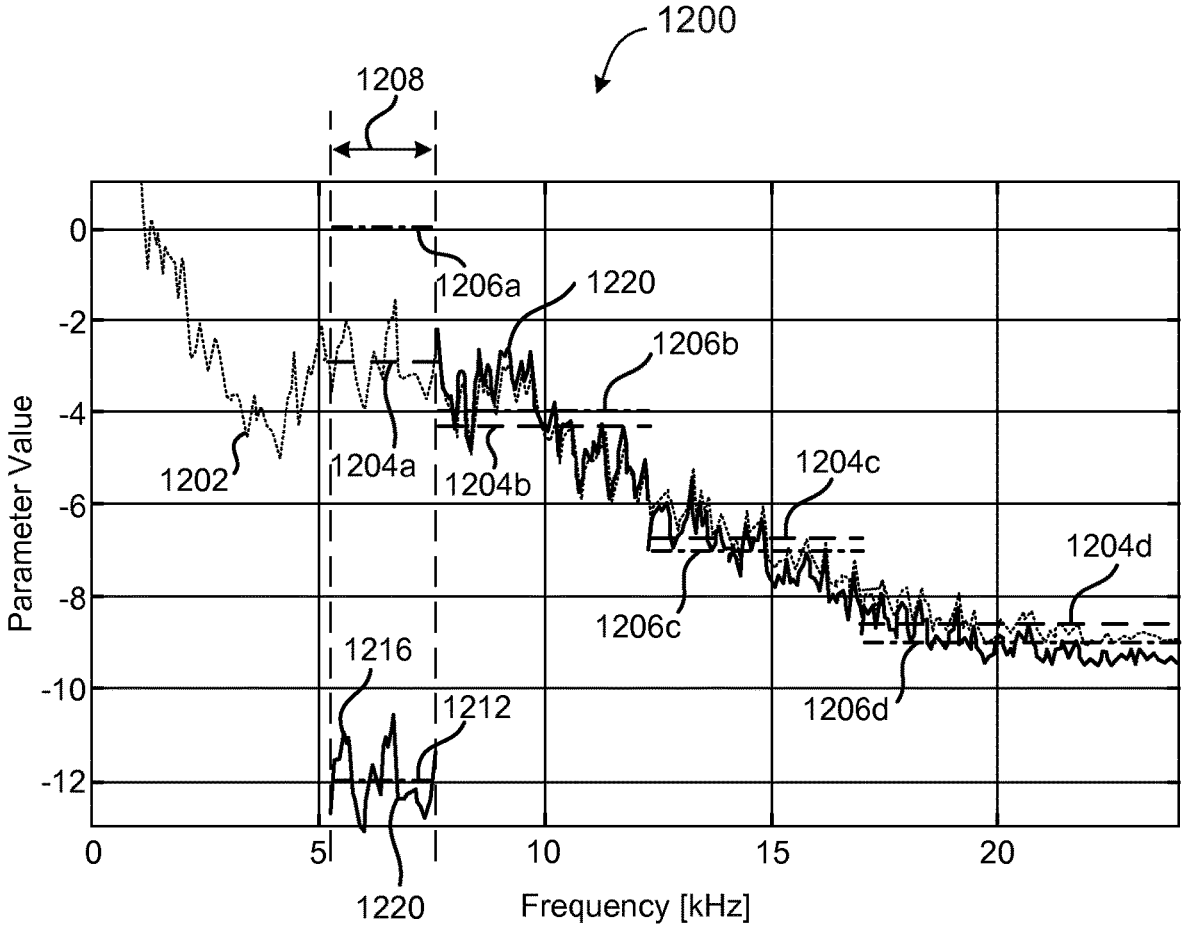
FIG. 12 is a graph 1200 showing an example of a second range extension technique.

FIG. 12 is a graph 1200 showing an example of a second range extension technique. In FIG. 12, an input signal spectrum 1202 is shown with unquantized parameter values 1204*a*, 1204*b*, 1204*c* and 1204*d*. Decoded parameter values are shown by traces 1206*a*, 1206*b*, 1206*c* and 1206*d*. In FIG. 12, only the decoded parameter value corresponding to trace 1206*a* in a first band 1208 has a value of 0 corresponding to codebook F0. The decoded parameter value of trace 1206*a* is transformed to a lower value of −12, illustrated by trace 1212. The remaining decoded values corresponding to traces 1206*b*-1206*d* substantially align with unquantized parameter values 1204*b*-1204*d*. Thus, a portion 1216 of a decoder output spectrum 1220 for first band 1208 has energy levels close to −12, while the energies of remaining portions of decoder output spectrum 1220 for higher frequencies are closer to the energies of input signal spectrum 1202.

Figure 13:
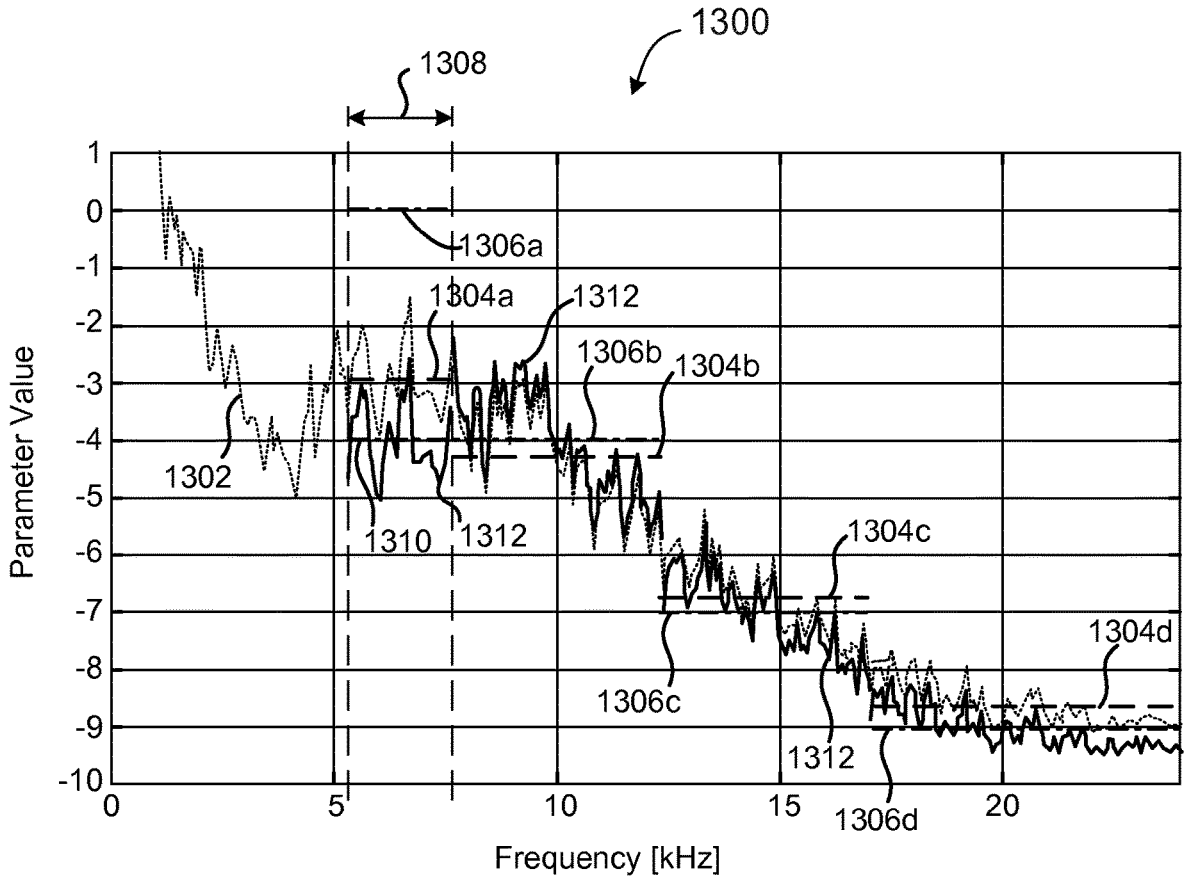
FIG. 13 is a graph 1300 showing an example of a third range extension technique.

FIG. 13 is a graph 1300 showing an example of a third range extension technique. In FIG. 13, an input signal spectrum 1302 is shown with unquantized parameter values 1304*a*, 1304*b*, 1304*c* and 1304*d*. Decoded parameter values are shown by traces 1306*a*, 1306*b*, 1306*c* and 1306*d*. In FIG. 13, decoded parameter value 1306*a* for a first frequency band 1308 corresponding to codebook F0=0 is transformed to a lower value by replacing decoded parameter value 1306*a* with decoded value 1306*b* of the first delta coded parameter corresponding to codebook DF, as represented by trace 1310, since the F0 value equals zero and the delta value for the first DF band is negative. The resulting decoder output spectrum 1312 is illustrated in FIG. 13.

Figure 14:
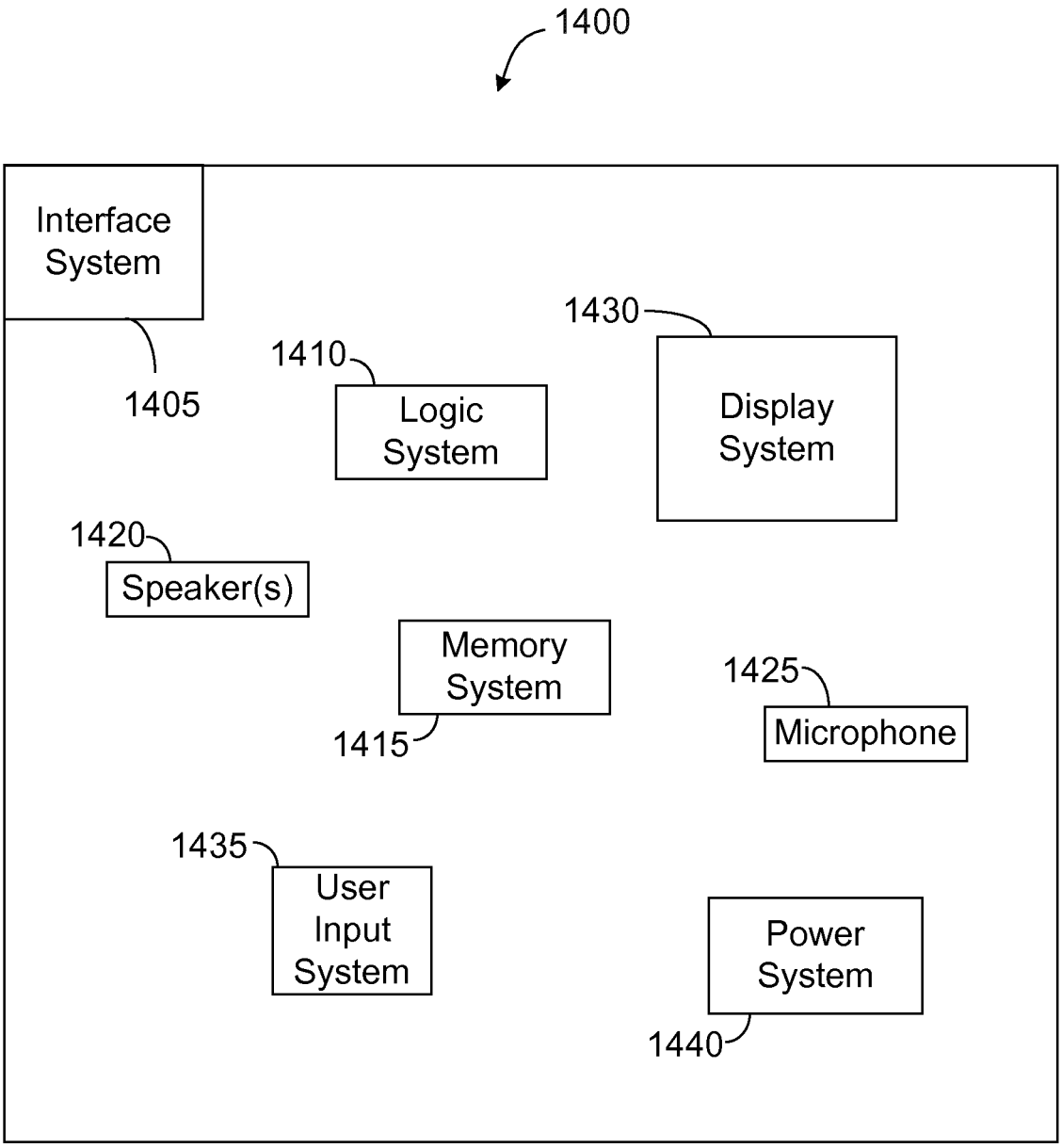
FIG. 14 is a block diagram showing an example of a data processing system 1400 providing an environment for implementing some examples of audio coding with range extension as disclosed herein.

FIG. 14 is a block diagram showing an example of a data processing system 1400 providing an environment for implementing some examples of audio coding with range extension as disclosed herein. System 1400 may be a mobile telephone, a smartphone, a desktop computer, a hand-held or portable computer, a netbook, a notebook, a smartbook, a tablet, a stereo system, a television, a DVD player, a digital recording device, or a variety of other devices.

In this example, system 1400 includes an interface system 1405. Interface system 1405 may include a network interface, such as a wireless network interface. Alternatively, or additionally, interface system 1405 may include a universal serial bus (USB) interface or another such interface.

System 1400 includes a logic system 1410. Logic system 1410 may include a processor, such as a general purpose single- or multi-chip processor. Logic system 1410 may include a digital signal processor (DSP), an application specific integrated circuit (ASIC), a field programmable gate array (FPGA) or other programmable logic device, discrete gate or transistor logic, or discrete hardware components, or combinations thereof. Logic system 1410 may be configured to control the other components of system 1400. Although no interfaces between the components of system 1400 are shown in FIG. 14, logic system 1410 may be configured for communication with the other components. The other components may or may not be configured for communication with one another, as appropriate.

Logic system 1410 may be configured to perform encoder and/or decoder functionality, including but not limited to the types of encoding and/or decoding processes described herein. In some such implementations, logic system 1410 may be configured to operate (at least in part) according to software stored on one or more non-transitory media. The non-transitory media may include memory associated with logic system 1410, such as random access memory (RAM) and/or read-only memory (ROM). The non-transitory media may include memory of memory system 1415. Memory system 1415 may include one or more suitable types of non-transitory storage media, such as flash memory, a hard drive, etc.

For example, logic system 1410 may be configured to receive frames of encoded audio data via interface system 1405 and to decode the encoded audio data according to the decoding processes described herein. Alternatively, or additionally, logic system 1410 may be configured to receive frames of encoded audio data via an interface between memory system 1415 and logic system 1410. Logic system 1410 may be configured to control speaker(s) 1420 according to decoded audio data. In some implementations, logic system 1410 may be configured to encode audio data according to conventional encoding methods and/or according to encoding methods described herein. Logic system 1410 may be configured to receive such audio data via microphone 1425, via interface system 1405, etc.

Display system 1430 may include one or more suitable types of display, depending on the manifestation of system 1400. For example, display system 1430 may include a liquid crystal display, a plasma display, a bistable display, etc.

User input system 1435 may include one or more devices configured to accept input from a user. In some implementations, user input system 1435 may include a touch screen that overlays a display of display system 1430. User input system 1435 may include buttons, a keyboard, switches, etc. In some implementations, user input system 1435 may include microphone 1425: a user may provide voice commands for system 1400 via microphone 1425. The logic system may be configured for speech recognition and for controlling at least some operations of system 1400 according to such voice commands.

Power system 1440 may include one or more suitable energy storage devices, such as a nickel-cadmium battery or a lithium-ion battery. Power system 1440 may be configured to receive power from an electrical outlet.

The techniques described herein can be implemented by one or more computing devices. For example, a controller of a special-purpose computing device may be hard-wired to perform the disclosed operations or cause such operations to be performed and may include digital electronic circuitry such as one or more application-specific integrated circuits (ASICs) or field programmable gate arrays (FPGAs) persistently programmed to perform operations or cause operations to be performed. In some implementations, custom hard-wired logic, ASICs, and/or FPGAs with custom programming are combined to accomplish the techniques.

In some other implementations, a general purpose computing device can include a controller incorporating a central processing unit (CPU) programmed to cause one or more of the disclosed operations to be performed pursuant to program instructions in firmware, memory, other storage, or a combination thereof. Examples of general-purpose computing devices include servers, network devices and user devices such as smartphones, tablets, laptops, desktop computers, portable media players, other various portable handheld devices, and any other device that incorporates data processing hardware and/or program logic to implement the disclosed operations or cause the operations to implemented and performed. A computing device may include a monitor, printer, or other suitable display for providing any of the results mentioned herein to a user.

The terms "storage medium" and "storage media" as used herein refer to any media that store data and/or instructions that cause a computer or type of machine to operation in a specific fashion. Any of the components, models, modules, units, engines and operations described herein may be at least partially implemented as or caused to be implemented by software code executable by a processor of a controller using any suitable computer language. The software code may be stored as a series of instructions or commands on a computer-readable medium for storage and/or transmission and for use by a computer program product. Examples of suitable computer-readable media include random access memory (RAM), read only memory (ROM), a magnetic medium such as a hard-drive or a floppy disk, an optical medium such as a compact disk (CD) or DVD (digital versatile disk), a solid state drive, flash memory, and any other memory chip or cartridge. The computer-readable medium may be any combination of such storage devices. Computer-readable media encoded with the software/program code may be packaged as part of a computer program product with a compatible device such as a user device or a server as described above or provided separately from other devices. Any such computer-readable medium may reside on or within a single computing device or an entire computer system, and may be among other computer-readable media within a system or network.

In some implementations, a non-transitory computer-readable storage medium stores instructions executable by a computing device to cause some or all of the operations described above to be performed. Non-limiting examples of computing devices include servers and desktop computers, as well as portable handheld devices such as a smartphone, a tablet, a laptop, a portable music player, etc. In some instances, one or more servers can be configured to encode and/or decode a digital audio signal using one or more of the disclosed techniques and stream a processed output signal to a user's device over the Internet as part of a cloud-based service.

Storage media is distinct from but may be used in conjunction with transmission media. Transmission media participates in transferring information between storage media. For example, transmission media includes coaxial cables, copper wire and fiber optics. Transmission media can also take the form of acoustic or light waves, such as those generated during radio-wave and infra-red data communications.

Despite references to particular computing paradigms and software tools herein, the disclosed techniques are not limited to any specific combination of hardware and software, nor to any particular source for the instructions executed by a computing device or data processing apparatus. Program instructions on which various implementations are based may correspond to any of a wide variety of programming languages, software tools and data formats, and be stored in any type of non-transitory computer-readable storage media or memory device(s), and may be executed according to a variety of computing models including, for example, a client/server model, a peer-to-peer model, on a stand-alone computing device, or according to a distributed computing model in which various functionalities may be effected or employed at different locations. In addition, references to particular protocols herein are merely by way of example. Suitable alternatives known to those of skill in the art may be employed.

Various modifications to the implementations described in this disclosure may be readily apparent to those skilled in the art. The general principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

The invention claimed is:

1. An audio coding system comprising:

an encoder implemented using at least one processor, the encoder configured to:

obtain parameters characterizing at least one property of an audio signal, the parameters varying in relation to a sequence of time frames of the audio signal and in relation to a sequence of frequency bands in each time frame, for each time frame:

encode a set of the parameters for the sequence of frequency bands in the time frame to produce a set of encoded values, the encoding using at least a first coding protocol of a set of coding protocols, and perform at least one of:

storing the set of encoded values on a storage medium, or providing the set of encoded values on a communications medium; and a decoder implemented using at least one processor, the decoder configured to, for each time frame:

perform at least one of:

retrieving the set of encoded values from the storage medium, or receiving the set of encoded values on the communications medium, decode the set of encoded values to produce a set of decoded values for the sequence of frequency bands in the time frame, the decoding using at least the first coding protocol, for at least one frequency band of the sequence of frequency bands in the time frame:

identify at least one decoded value as corresponding to a minimum of a first range of values of the first coding protocol, and modify the identified at least one value to be a negative value below the minimum of the first range of values to produce an extended at least one value, and output the set of decoded values comprising the extended at least one value.

2. The system of claim 1, wherein:

the at least one frequency band of the sequence of frequency bands in the time frame is only a lowest frequency band of the sequence of frequency bands.

3. The system of claim 2, wherein the decoder is further configured to, for each time frame:

identify a second decoded value associated with a second frequency band of the sequence of frequency bands in the time frame as being below the minimum of the first range of values, and provide the second value as the extended at least one value.

4. The system of claim 2, wherein the decoder is further configured to, for each time frame:

identify a plurality of second decoded values associated with an upper range of frequency bands of the sequence of frequency bands in the time frame, and determine the extended at least one value as an extrapolation of the second decoded values.

5. The system of claim 1, wherein:

the extended at least one value is associated with an energy level at or below a designated threshold of perception.

6. The system of claim 1, wherein the encoding comprises at least frequency coding, the frequency coding comprising:

direct coding a first parameter associated with a first frequency band of the sequence of frequency bands using the first coding protocol, and frequency-differential coding at least one second parameter associated with at least one frequency band following the first frequency band of the sequence of frequency bands using a second coding protocol different from the first coding protocol.

7. The system of claim 6, wherein the first and second coding protocols are defined by Huffman codebooks.

8. The system of claim 1, wherein the parameters characterize an energy level of the audio signal, and each encoded value in the set represents an energy level of a respective frequency band of the sequence of frequency bands in the time frame.

9. An audio decoding process comprising:

receiving a set of encoded values for a sequence of frequency bands in an identifiable time frame of an audio signal, the encoded values varying in relation to a sequence of time frames of the audio signal and in relation to the sequence of frequency bands;

for the identifiable time frame, decoding the set of encoded values to produce a set of decoded values for the sequence of frequency bands in the time frame, the decoding using at least a first coding protocol of a set of coding protocols, the first coding protocol associated with direct coding of the audio signal;

for at least one frequency band of the sequence of frequency bands in the identifiable time frame:

determining that at least one decoded value corresponds to a minimum of a first range of values of the first coding protocol, and modifying the determined at least one value to be a negative value below the minimum of the first range of values to produce an extended at least one value; and providing the set of decoded values comprising the extended at least one value for processing.

10. The process of claim 9, wherein: the at least one frequency band of the sequence of frequency bands in the identifiable time frame is only a lowest frequency band of the sequence of frequency bands.

11. The process of claim 10, further comprising:

for the at least one frequency band of the sequence of frequency bands in the identifiable time frame:

identifying a second decoded value associated with a second frequency band of the sequence of frequency bands in the identifiable time frame as being below the minimum of the first range of values, and providing the second value as the extended at least one value.

12. The process of claim 10, further comprising:

for the at least one frequency band of the sequence of frequency bands in the identifiable time frame:

identifying a plurality of second decoded values associated with an upper range of frequency bands of the sequence of frequency bands in the identifiable time frame, and determining the extended at least one value as an extrapolation of the second decoded values.

13. A non-transitory computer-readable medium storing program code to be executed by at least one processor, the program code comprising instructions configured to cause performance of the operations of claim 9.

14. An audio decoding process comprising:

receiving a set of decoded values for a sequence of frequency bands in an identifiable time frame of an audio signal, the decoded values varying in relation to a sequence of time frames of the audio signal and in relation to the sequence of frequency bands;

for at least one frequency band of the sequence of frequency bands in the identifiable time frame:

determining that a decoded value corresponds to a minimum of a first range of values of a first coding protocol of a set of coding protocols, the first coding protocol associated with direct coding of the audio signal, and modifying the determined value to be a negative value below the minimum of the first range of values to produce an extended value; and providing the extended value for processing.

15. The process of claim 14, wherein: the at least one frequency band of the sequence of frequency bands in the identifiable time frame is only a lowest frequency band of the sequence of frequency bands.

16. The process of claim 15, further comprising:

for the at least one frequency band of the sequence of frequency bands in the identifiable time frame:

identifying a second decoded value associated with a second frequency band of the sequence of frequency bands in the time frame as being below the minimum of the first range of values, and providing the second value as the extended at least one value.

17. The process of claim 15, further comprising:

for the at least one frequency band of the sequence of frequency bands in the identifiable time frame:

identifying a plurality of second decoded values associated with an upper range of frequency bands of the sequence of frequency bands in the identifiable time frame, and determining the extended at least one value as an extrapolation of the second decoded values.

* * * * *